United States Patent [19]

Dhyanchand

[11] Patent Number: 5,013,929

[45] Date of Patent: May 7, 1991

[54] POWER CONVERSION SYSTEM HAVING PRIME MOVER START CAPABILITY

[75] Inventor: P. John Dhyanchand, Rockford, Ill.

[73] Assignee: Sundstrand Corporation, Rockford, Ill.

[21] Appl. No.: 440,273

[22] Filed: Nov. 22, 1989

[51] Int. Cl.[5] ..... F02N 11/04

[52] U.S. Cl. ..... 290/31; 322/29

[58] Field of Search ..... 290/10, 22, 31, 46; 322/10, 29

[56] References Cited

U.S. PATENT DOCUMENTS

| | | | |
|---|---|---|---|
| 3,908,161 | 9/1975 | Messenger | 322/29 |
| 4,743,777 | 5/1988 | Shilling et al. | 290/46 |
| 4,786,852 | 11/1988 | Cook | 322/10 |
| 4,830,412 | 5/1989 | Raad et al. | 290/31 |
| 4,841,216 | 6/1989 | Okada et al. | 322/29 X |
| 4,947,100 | 8/1990 | Dhyanchand et al. | 322/10 |
| 4,948,209 | 8/1990 | Baker et al. | 322/29 X |
| 4,956,598 | 9/1990 | Recker et al. | 322/29 X |

*Primary Examiner*—A. D. Pellinen
*Assistant Examiner*—W. E. Duncanson, Jr.
*Attorney, Agent, or Firm*—Marshall, O'Toole, Gerstein, Murray & Bicknell

[57] ABSTRACT

A power conversion system utilizes a brushless generator driven by a prime mover when operating in a generating mode and drives the prime mover when operating in a starting mode. The system includes an AC/DC power rectifier and an inverter coupled to the AC/DC power rectifier for developing at least one AC voltage. Contactors are provided for coupling, when in the generating mode, the generator to the rectifier input and the inverter output to an AC load during operation in the generating mode, and for coupling an external power source to the rectifier input and the inverter output to the generator during operation in the starting mode. Transformers are provided for adjusting system voltages so that the generator windings need not be modified to accomplish starting of the prime mover.

9 Claims, 3 Drawing Sheets

POWER CONVERSION SYSTEM HAVING PRIME MOVER START CAPABILITY

TECHNICAL FIELD

The present invention relates generally to power conversion systems, and more particularly to such systems which may be used in a generating mode to convert mechanical power into electrical power or in a starting mode to convert electrical power into motive power for starting a prime mover.

BACKGROUND ART

In a power conversion system such as a variable speed, constant frequency (VSCF) power generating system, a brushless, three-phase synchronous generator operates in a generating mode to convert variable speed motive power supplied by a prime mover into variable frequency AC power. The variable frequency power is rectified and provided over a DC link to a controllable static inverter. The inverter is operated to produce constant frequency AC power, which is then supplied over a load bus to one or more loads.

As is known, a generator can be operated as a motor in a starting mode to convert electrical power supplied by an external AC power source into motive power which may in turn be provided to the prime mover to bring it up to self-sustaining speed. In the case of a brushless, synchronous generator having a permanent magnet generator (PMG), an exciter portion and a main generator portion mounted on a common shaft, it has been shown to provide power at a controlled voltage and frequency to the armature windings of the main generator portion and to provide field current to the main generator portion via the exciter portion so that the motive power may be developed. This has been accomplished in the past using two separate inverters, one to provide power to the main generator portion armature windings and the other to provide power to the exciter portion.

Cook, U.S. Pat. No. 4,786,852, assigned to the assignee of the instant invention, discloses a starting system in which a brushless generator is operated as a motor to bring an engine up to self-sustaining speed. A rectifier bridge of a VSCF system is modified by adding transistors in parallel with the rectifiers of the bridge and the transistors are operated during a starting mode of operation to convert DC power provided on a DC link by a separate VSCF system or auxiliary power unit into AC power. The AC power is applied to armature windings of the brushless generator to cause a rotor of the generator to be accelerated.

Shilling, et al., U.S. Pat. No. 4,743,777 discloses a starter generator system using a brushless, synchronous generator. The system is operable in a starting mode to produce motive power from electrical power provided by an external AC power source. An exciter of the generator includes separate DC and three-phase AC field windings disposed in a stator. When operating in a starting mode at the beginning of a starting sequence, the AC power developed by the external AC power source is directly applied to the three-phase AC exciter field windings. The AC power developed by the external AC source is further provided to a variable voltage, variable frequency power converter which in turn provides a controlled voltage and frequency to the armature windings of a main generator. The variable voltage, variable frequency power converter is capable of being alternatively connected to drive the dynamoelectric machine as a starting motor or to receive power from the machine during generator operation. The AC power provided to the AC exciter field windings is transferred by transformer action to exciter armature windings disposed on a rotor of the generator. This AC power is rectified by a rotating rectifier and provided to a main field winding of the generator. The interaction of the magnetic fields developed by the main generator field winding and armature windings in turn causes the rotor of the generator to rotate and thereby develop the desired motive power. When the generator is operated in a generating mode, switches are operated to disconnect the AC exciter field windings from the external AC source and to provide DC power to the DC exciter field winding. The variable voltage, variable frequency power converter is thereafter operated to produce AC output power at a fixed frequency.

Messenger, U.S. Pat. No. 3,908,161 discloses a brushless generator including three exciter field windings which are connected in a wye configuration and are provided with three-phase AC power during operation in a starting mode. The three-phase AC power induces AC power in an exciter armature winding which is rectified and applied to a main generator field winding. Main armature windings receive controlled AC power from a cycloconverter to in turn cause rotation of the generator rotor. Thereafter, the three exciter field windings are connected in series and provided with DC excitation when operating in a generating mode.

SUMMARY OF THE INVENTION

In accordance with the present invention, an improved system is provided for generation of AC power and for starting of a prime mover.

More particularly, a power conversion system utilizing a brushless generator having armature windings and driven by a prime mover includes a first set of contactors coupled to the armature windings, a first transformer coupled to the first contactor set, an AC/DC power rectifier coupled by a second set of contactors to the first transformer, a DC link coupled to the AC/DC power rectifier, an inverter coupled to the DC link, and a second transformer coupled by a third set of contactors to the inverter. When operating in the generating mode, the inverter develops at least one AC voltage which is provided by the second transformer to an AC load.

The system is also operable in a starting mode to convert AC power supplied by an AC source into motive power for starting the prime mover. An external AC source is coupled through the second transformer and the third set of contactors to the converter input, and the resulting AC voltage at the inverter output is coupled by the first set of contactors directly to the armature windings of the main generator. As a consequence, a controlled AC voltage is applied to the armature windings without the need for a separate converter-inverter, and this voltage causes the generator to operate as a motor which starts the prime mover.

In the preferred embodiment, the transformers comprise autotransformers which adjust the levels of voltages within the power conversion system so that the windings of the generator need not be modified to permit use of the system in both the generating and starting modes. A circuit may also be provided for sensing the rotational speed of the prime mover and shifting from the starting mode to the generating mode when the speed of the prime mover reaches a particular level.

DESCRIPTION OF THE PREFERRED EMBODIMENT

Figure 1:
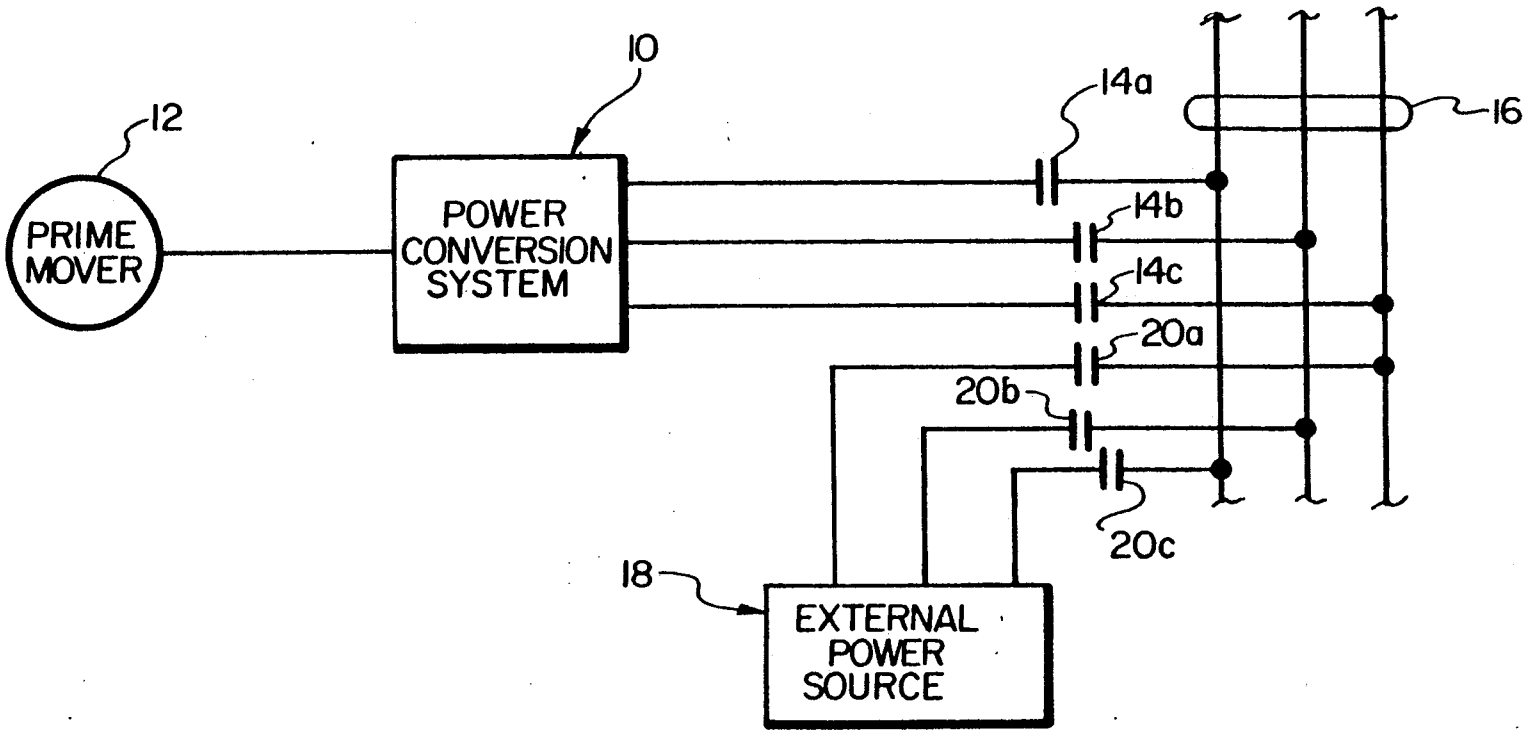
FIG. 1 is a block diagram of a power generating system incorporating the present invention.

Referring now to FIG. 1, a power conversion system 10 in the form of a variable speed, constant frequency (VSCF) system operates in a generating mode to convert variable speed motive power produced by a prime mover 12, such as an aircraft jet engine, into constant frequency three-phase AC electrical power which is delivered through controllable contactors 14*a*, 14*b*, 14*c* to a load bus 16. The VSCF system 10 is also operable in a starting mode using three-phase AC power provided by an external power source 18, such as a ground power cart, which, in the starting mode, is in turn coupled to the load bus 16 through controllable contactors 20*a*–20*c*. Alternatively, the electrical power for use by the VSCF system 10 in the starting mode may be provided by another source of power, such as another VSCF system which is driven by a different prime mover. In any event, the VSCF system 10 converts electrical power into motive power when operating in the starting mode to bring the prime mover 12 up to self-sustaining speed. Once this self-sustaining speed (also referred to as "light-off") is reached, the prime mover 12 may be accelerated to operating speed, following which operation in the generating mode may commence.

Figure 2:
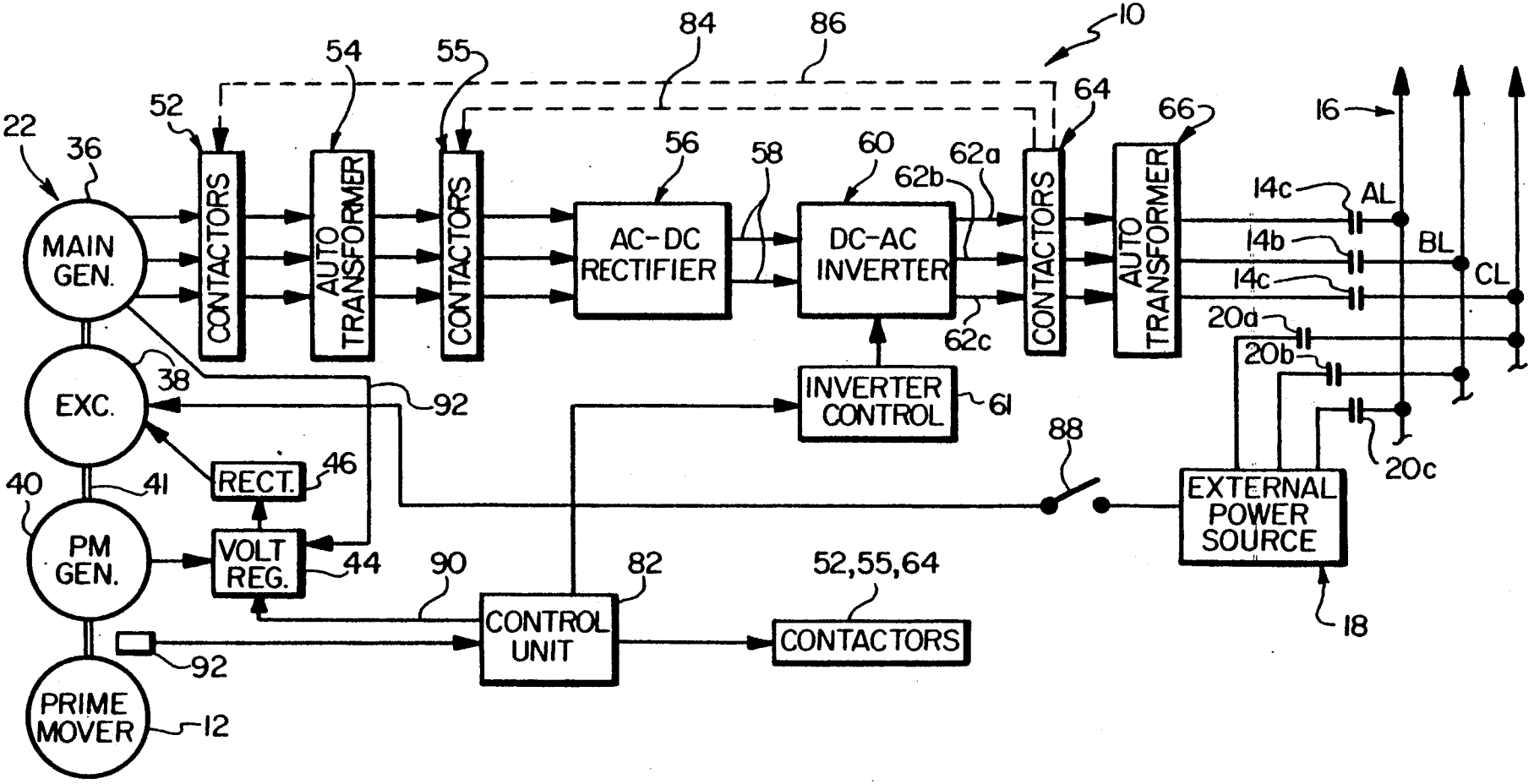
FIG. 2 shows a combined mechanical and electrical block diagram of the power generating system shown in FIG. 1.

Referring now to FIG. 2 which shows the system in greater detail, the VSCF system 10 includes a generator 22 driven by the prime mover 12. Preferably, the generator 22 is of the brushless, synchronous type, although a different generator may be used, such as a permanent magnet generator.

Figure 3:
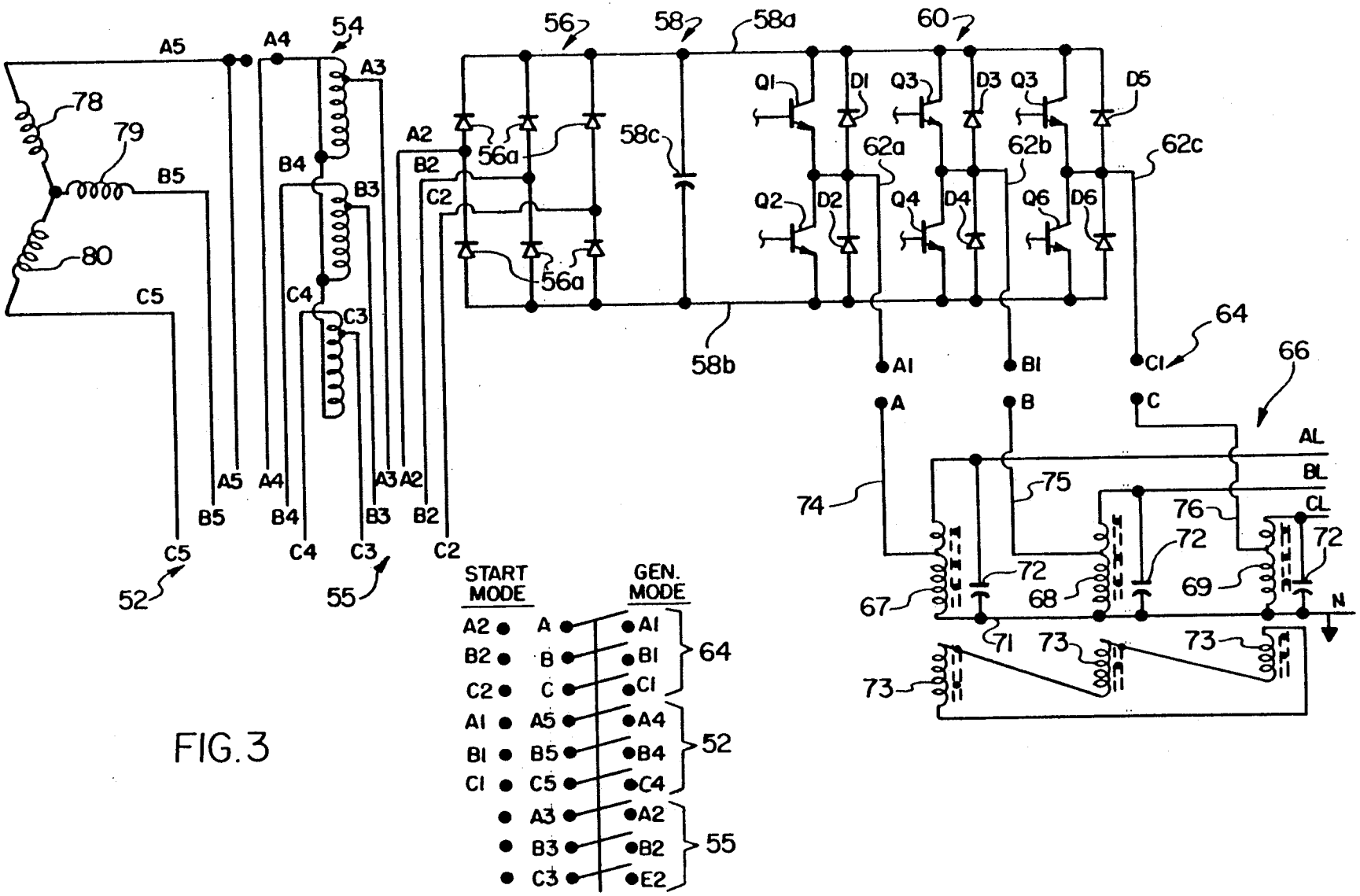
FIG. 3 is a simplified schematic diagram of the electrical power converter components of FIG. 2, together with the generator armature windings.

The generator 22 includes a main generator portion 36 including three armature windings 78,79,80 shown in FIG. 3, an exciter portion 38 and a permanent magnet generator (PMG) 40, all of which include rotor structures mounted on a common shaft 41 of a rotor. In the generating mode of operation, rotation of the common shaft 41 by the prime mover 12 causes polyphase power to be developed in armature windings of the PMG 40 which is in turn delivered to a voltage regulator 44. The voltage regulator 44 and a rectifier 46 deliver a controlled magnitude of DC current to field windings of the exciter 38. This current induces an AC voltage in armature windings of the exciter 38 which is rectified by a rotating rectifier. The resulting DC power from the exciter 38 is supplied to a field winding (not shown) of the main generator 36. Rotation of the common shaft 41 while the field current is flowing in the field winding of the main generator portion 36 causes polyphase voltages to be developed in armature windings of the main generator portion 36. The frequency of these voltages varies with the speed of the shaft 41. These voltages are supplied through a first set of contactors 52, an autotransformer 54 and a second set of contactors 55 to an AC/DC power rectifier 56. The autotransformer 54 reduces the voltage supplied to the three-phase rectifier 56, and the latter converts the AC power into first and second DC potentials on first and second conductors 58*a*, 58*b* (FIG. 3) of a DC link 58. With reference to FIG. 3, the rectifier 56 is formed by a plurality of power diodes 56*a* connected in a bridge arrangement. A filter capacitor 58*c* is connected across the conductors 58*a* and 58*b*.

The DC power on the DC link 58 is provided to an inverter 60 comprising power switches Q1–Q6 (FIG. 3) which are connected in a bridge configuration together with flyback diodes D1–D6, the diodes being connected across the emitter-collector terminals of the transistor switches Q1–Q6. The switches Q1–Q6 are operated by an inverter control 61 (shown in FIG. 2 but not shown in FIG. 3 for clarity) to produce substantially constant frequency three-phase AC power which is provided on three conductors 62*a*, 62*b* and 62*c*.

The three conductors 62*a*, 62*b*, 62*c* are connected to a third set of contactors 64 which, in the generating mode, connect the inverter output to another autotransformer 66. The transformer output, in turn, is connected by the contactors 14*a*, 14*b*, 14*c* to the load bus 16. As previously mentioned, in the generating mode the rotating prime mover 12 provides the energy to produce the constant frequency voltage on the load bus 16. During this operation, the contactors 14*a*, 14*b*, 14*c* are closed and the contactors 20*a*, 20*b* and 20*c* are opened.

During operation in the starting mode, assume that initially the prime mover 12 is stationary. The external power source 18 is connected to the load bus 16 by closing the contactors 20*a*, 20*b* and 20*c*, and the contactors 14*a*, 14*b* and 14*c* are also closed to connect the three-phase AC power to the autotransformer 66. With reference to FIG. 3, the autotransformer 66 comprises three transformer windings 67, 68 and 69, each winding having one end connected to a neutral or ground 71 and another end connected to one of the three conductors of the load bus 16. A capacitor 72 is connected across each winding 67,68,69. Tertiary windings 73 are also magnetically linked with the autotransformer windings 67–69 to maintain the output voltages at balanced levels during unbalanced load conditions. The autotransformer outputs in the starting mode (which are the inputs of the transformers when in the generating mode) are connected by lines 74, 75 and 76 to contacts A, B and C of the contactors 64.

The three sets of contactors 52, 55 and 64 and their connections in the system are illustrated diagrammatically as switches in FIG. 3 for ease of understanding. Each of the contactors 52 and 64 is represented by three sets of double-throw switches, while the contactor set 55 is represented by a set of single-throw switches. The movable contacts of all of the switches are illustrated as being ganged, i.e., connected together for simultaneous operation.

The movable contacts A, B and C (which are connected to the autotransformers 67, 68 and 69) of the contactors 64 are movable to contacts A1, B1 and C1 when in the generating mode, and to contacts A2, B2 and C2 (the converter input) when in the starting mode. Movable contacts A5, B5 and C5 (which are connected to the armature windings 78, 79 and 80) of the contactors 52 are movable to the contacts A4, B4 and C4 (connected to the primary windings of the autotransformer 54) when in the generating mode, and to the contacts A1, B1 and C1 (connected to the output of the inverter 60) when in the starting mode.

Movable contacts A3, B3 and C3 (connected to the secondary windings of the autotransformer 54) of the contactors 55 are movable to the contacts A2, B2 and C2 (connected to the input of the rectifier 56) when in the generating mode. In the starting mode, the movable contacts A3, B3 and C3 are opened.

With reference once again to FIG. 2, during operation in the generating mode, assuming that the prime mover 12 is running at a self-sustaining speed, a control unit 82 moves the contactors 52 and 55 to the positions shown in solid lines in FIGS. 2 and 3 whereby the generator 36 armature windings 78–80 are coupled through the autotransformer 54 to the rectifier 56. The resulting DC power on the DC link is converted by the inverter 60 into constant-frequency AC power under control of the inverter control 61. The output of the inverter 60 is coupled through the contactors 64, the autotransformer 66 and the contactors 14*a*–14*c* to the bus 16. The contactors 20*a*, 20*b* and 20*c* are opened during this time.

During operation in the starting mode, the prime mover 12 is initially at standstill, the contactors 14*a*, 14*b* and 14*c* are closed and the contactors 20*a*, 20*b* and 20*c* are also closed. The control unit 82 moves the contactors 52, 55 and 64 to the start mode positions shown in FIG. 3. AC power flows from the source 18 through the load bus 16, the autotransformer 66, and the contactors 64 to the input of the rectifier 56. The dashed line 84 in FIG. 2 indicates the power flow through the contactors 64. The rectifier 56 produces DC power on the DC link 58 connected to the inverter 60. During the starting mode, the control unit 82 commands the inverter control 61 to cause the inverter output voltage and frequency to start at a low value and gradually increase at a constant volts-per-hertz ratio. The AC power is coupled through the contactors 52 (illustrated diagrammically by the dashed line 86) to the armature windings 78, 79, 80 of the main generator 36. During this time, the contacts A2,B2,C2 are disconnected from the contacts A3,B3,C3 so that the autotransformer 54 is disconnected from the system.

In the starting mode, the source 18 is also connected to the exciter 38 by closing a switch 88, so that main field current for the generator 36 is developed. This generation of the main field current together with the power to the armature windings 78, 79 and 80 causes the shaft 41 to rotate and drive the prime mover 12. When the prime mover 12 reaches the self-sustaining speed, a rotational speed sensor 92 adjacent the shaft 41 signals the control unit 82 to move the contactors 52, 55 and 64 to the generating mode, to open the contactors 20*a*, 20*b* and 20*c*, and to open the switch 88. The system then continues in operation in the generating mode.

The control unit 82 is also connected by a line 90 to the voltage regulator 44 to enable the regulator 44 to provide exciter field current to the exciter 38 after the prime mover 12 has reached self-sustaining speed and the system is switched to the generating mode. A line 93 also connects the output of the generator 36 to the voltage regulator 44. In the generating mode, a signal representing the magnitude of the generator 36 output voltage appears on the line 93, and the regulator 44 controls the exciter field current to the exciter 38 in order to hold or regulate the generator 36 output voltage.

The following are operating ranges in a specific example of the invention. These figures are given to aid the understanding of the invention, and it should be understood that the invention is not limited to a system having these figures. In the generating mode, the main generator 36 produces 220 volts line to neutral at between 1,000 Hz and 2,000 Hz. The autotransformer 54 steps down this voltage to 115 volts, and the rectifier 56 produces 270 volts DC on the link 58. The inverter 60 produces a line-to-line voltage of 115 volts at 400 Hz. Whereas the inverter 60 produces a three line output, the autotransformer 66 produces a four line output of 115 volts line to neutral. The autotransformer 66 also reduces harmonics.

In the start-up mode, the voltage and frequency of the external power source 18 are proper for start-up purposes. The autotransformer 54 is bypassed because it is designed for the relatively high frequency range of 1,000 Hz to 2,000 Hz; if the low frequency fed to the generator 36 during start-up were passed to the autotransformer 54, the transformer 54 would be saturated.

It should be noted that the inverter control 61 and the control unit 82 may be implemented by software or hardware or both, and the designs of such circuits are straightforward given the description contained herein.

I claim:

1. A power conversion system operable in a generating mode to convert motive power into electrical power and in a starting mode to convert electrical power into motive power utilizing an external power source and a generator having armature windings, comprising:

an AC/DC power rectifier;

a DC/AC inverter;

a DC link coupling said rectifier with said inverter;

said rectifier having an input and said inverter having an output;

a first transformer and a second transformer;

first means operable when in said generating mode to couple the armature windings to said first transformer and operable when in said starting mode to couple the armature windings to said output;

said first means further being operable when in said generating mode to couple said first transformer to said input;

said first means still further being operable when in said generating mode to couple said output to said second transformer; and second means operable when in said generating mode to couple said second transformer to an AC load and when in said starting mode to couple said second transformer to the external power source.

2. The power conversion system of claim 1, wherein said first and second transformers are autotransformers.

3. The power conversion system of claim 1, wherein said first means comprises first contactors connected to said windings and connectable to either said first transformer or said output, second contractors connected to said first transformer and connectable to said input, and third contactors connected to said second transformer and connectable to either said output or said input.

4. The, power conversion system of claim 1, further including a control unit to said motive power for controlling said first means.

5. A power conversion system operable in a generating mode to convert motive power into electrical power and in a starting mode to convert electrical power into motive power utilizing an external power source and a generator having armature windings, comprising:

an AC/DC power rectifier having an input and an output;

a DC/AC inverter having an input coupled to said output of said rectifier;

first means operable during operation in the generating mode for connecting said input of said AC/DC power rectifier to the generator armature windings whereby AC power developed by the generator in response to the application of motive power thereto is converted into AC power on said output of said inverter;

control means coupled to said inverter for operating same while in the generating mode so that said inverter produces substantially constant frequency AC power for an AC load;

second means operable in said generating mode for connecting said output of said inverter to an AC load;

said first and second means further being operable in said starting mode to couple the external power source to said input of said rectifier and said output of said inverter to said armature windings whereby said inverter provides AC power to the generator armature windings and causes same to operate as a motor; and a first autotransformer coupled between said first means and said AC/DC rectifier while in said generating mode.

6. The power conversion system of claim 5, and further including third means coupling said first autotransformer with said rectifier while in said generating mode and uncoupling said first autotransformer from said converter while in said starting mode.

7. The power conversion system of claim 5, and further including a second autotransformer coupled between said second means and the AC load while in the generating mode.

8. The power conversion system of claim 5, and further including control means connected to said first and second means for changing operation between said generating and starting modes.

9. The power conversion system of claim 6, and further including control means connected to said first, second and third means for changing operation between said generating and starting modes.

* * * * *